US012188208B2

(12) United States Patent
Kadono

(10) Patent No.: US 12,188,208 B2
(45) Date of Patent: Jan. 7, 2025

(54) SYSTEM AND METHOD FOR CONTROLLING WORK MACHINE, AND WORK MACHINE

(71) Applicant: KOMATSU LTD., Tokyo (JP)

(72) Inventor: Yuuichi Kadono, Tokyo (JP)

(73) Assignee: KOMATSU LTD., Tokyo (JP)

( * ) Notice: Subject to any disclaimer, the term of this patent is extended or adjusted under 35 U.S.C. 154(b) by 273 days.

(21) Appl. No.: 17/908,711

(22) PCT Filed: May 13, 2021

(86) PCT No.: PCT/JP2021/018271
§ 371 (c)(1),
(2) Date: Sep. 1, 2022

(87) PCT Pub. No.: WO2021/256136
PCT Pub. Date: Dec. 23, 2021

(65) Prior Publication Data

US 2023/0160184 A1 May 25, 2023

(30) Foreign Application Priority Data

Jun. 19, 2020 (JP) ..... 2020-105941

(51) Int. Cl.
*E02F 9/26* (2006.01)
*E02F 3/84* (2006.01)
*E02F 9/20* (2006.01)

(52) U.S. Cl.
CPC ..... *E02F 9/262* (2013.01); *E02F 3/841* (2013.01); *E02F 9/2041* (2013.01)

(58) Field of Classification Search
CPC ..... E02F 9/262; E02F 3/841; E02F 9/2041
See application file for complete search history.

(56) References Cited

U.S. PATENT DOCUMENTS 6,845,311 B1 * 1/2005 Stratton ..... E02F 3/847 37/417
2013/0081831 A1 4/2013 Hayashi
(Continued)

FOREIGN PATENT DOCUMENTS

JP 5247939 B1 7/2013
JP 2018-16971 A 2/2018
(Continued)

OTHER PUBLICATIONS

The International Search Report for the corresponding international application No. PCT/JP2021/018271, issued on Jul. 7, 2021.

*Primary Examiner* — Dale W Hilgendorf
*Assistant Examiner* — Hana Lee
(74) *Attorney, Agent, or Firm* — Global IP Counselors, LLP

(57) ABSTRACT

A controller acquires a target soil amount in one work path with respect to an actual topography. The controller determines a target profile in the one work path based on the target soil amount. The controller performs work in the one work path by operating a work implement according to the target profile. The controller acquires a maximum traction force of the work machine during the one work path. The controller determines whether the maximum traction force is smaller than a reference traction force. The controller increases the target soil amount in a next work path when the maximum traction force is smaller than the reference traction force. The controller determines the target profile in the next work path based on the increased target soil amount.

9 Claims, 15 Drawing Sheets

(56) References Cited

U.S. PATENT DOCUMENTS

| | | | | |
|---|---|---|---|---|
| 2014/0180444 | A1 | 6/2014 | Edara et al. | |
| 2016/0076223 | A1 | 3/2016 | Wei et al. | |
| 2016/0201298 | A1 | 7/2016 | Taylor et al. | |
| 2018/0355587 | A1* | 12/2018 | Hashimoto | E02F 3/844 |
| 2019/0078297 | A1 | 3/2019 | Ishibashi et al. | |
| 2019/0301143 | A1* | 10/2019 | Miller | B60K 35/00 |
| 2020/0291616 | A1 | 9/2020 | Ishibashi et al. | |
| 2021/0189690 | A1* | 6/2021 | Hyodo | E02F 3/3417 |

FOREIGN PATENT DOCUMENTS

| | | | |
|---|---|---|---|
| JP | 2018-16974 | A | 2/2018 |
| JP | 2020-33790 | A | 3/2020 |

* cited by examiner

SYSTEM AND METHOD FOR CONTROLLING WORK MACHINE, AND WORK MACHINE

CROSS-REFERENCE TO RELATED APPLICATIONS

This application is a U.S. National stage application of International Application No. PCT/JP2021/018271, filed on May 13, 2021. This U.S. National stage application claims priority under 35 U.S.C. § 119(a) to Japanese Patent Application No. 2020-105941, filed in Japan on Jun. 19, 2020, the entire contents of which are hereby incorporated herein by reference.

TECHNICAL FIELD

The present disclosure relates to a system and a method for controlling a work machine, and a work machine.

BACKGROUND INFORMATION

A control for automatically adjusting a position of a work implement, such as a blade, has been conventionally proposed for work vehicles, such as bulldozers or graders. For example, in Japanese Patent Publication No. 5247939, the position of the blade is automatically adjusted by a load control that makes the load on the blade match a target load in digging work.

SUMMARY

With the conventional control described above, the occurrence of shoe slip can be suppressed by raising the blade when the load on the blade becomes excessively large. This allows the work to be performed efficiently.

However, with the conventional control, as illustrated in FIG. 15, the blade is first controlled to conform to a design topography 100. If the load on the blade subsequently increases, the blade is raised by the load control (see a trajectory 200 of the blade in FIG. 15). Therefore, when a topography 300 with large undulations is dug, the load applied to the blade may increase rapidly, causing the blade to rise suddenly. If that happens, a topography with large unevenness will be formed. Once the topography with large unevenness is formed, it becomes difficult to perform subsequent digging work smoothly. Therefore, it is preferable to perform digging work in such a way that a topography with large unevenness is not formed.

An object of the present disclosure is to perform work efficiently under automatic control and to prevent a topography with large unevenness from being formed due to the work.

A system according to a first aspect of the present disclosure is a system for controlling a work machine including a work implement. The system includes a sensor and a controller. The sensor detects a current position of the work machine. The controller communicates with the sensor. The controller is programmed to execute the following processes. The controller acquires current position data indicative of the current position of the work machine. The controller acquires actual topography data indicative of an actual topography to be worked by the work machine. The controller acquires a target soil amount in one work path with respect to the actual topography. The controller determines a target profile in the one work path based on the target soil amount. The controller performs work in the one work path by operating the work implement according to the target profile. The controller acquires a maximum traction force of the work machine during the one work path. The controller determines whether the maximum traction force is smaller than a reference traction force. The controller increases the target soil amount in a next work path when the maximum traction force is smaller than the reference traction force. The controller determines the target profile in the next work path based on the increased target soil amount.

A method according to a second aspect of the present disclosure is a method for controlling a work machine including a work implement. The method includes the following processes. A first process is to acquire current position data indicative of a current position of the work machine. A second process is to acquire actual topography data indicative of an actual topography to be worked by the work machine. A third process is to acquire a target soil amount in one work path with respect to the actual topography. A fourth process is to determine a target profile in the one work path based on the target soil amount. A fifth process is to perform work in the one work path by operating the work implement according to the target profile. A sixth process is to acquire a maximum traction force of the work machine during the one work path. A seventh process is to determine whether the maximum traction force is smaller than a reference traction force. An eighth process is to increase the target soil amount in a next work path when the maximum traction force is smaller than the reference traction force. A ninth process is to determine the target profile in the next work path based on the increased target soil amount. The execution order of the processes is not limited to the above order and may be changed.

A work machine according to a third aspect of the present disclosure is a work machine including a work implement, a sensor, and a controller. The sensor detects a current position of the work machine. The controller communicates with the sensor. The controller is programmed to execute the following processes. The controller acquires current position data indicative of the current position of the work machine. The controller acquires actual topography data indicative of an actual topography to be worked by the work machine. The controller acquires a target soil amount in one work path with respect to the actual topography. The controller determines a target profile in the one work path based on the target soil amount. The controller performs work in the one work path by operating the work implement according to the target profile. The controller acquires a maximum traction force of the work machine during the one work path. The controller determines whether the maximum traction force is smaller than a reference traction force. The controller increases the target soil amount in a next work path when the maximum traction force is smaller than the reference traction force. The controller determines the target profile in the next work path based on the increased target soil amount.

According to the present disclosure, it is possible to perform work efficiently under automatic control and to prevent a topography with large unevenness from being formed due to the work.

DESCRIPTION OF EMBODIMENTS

Figure 1:
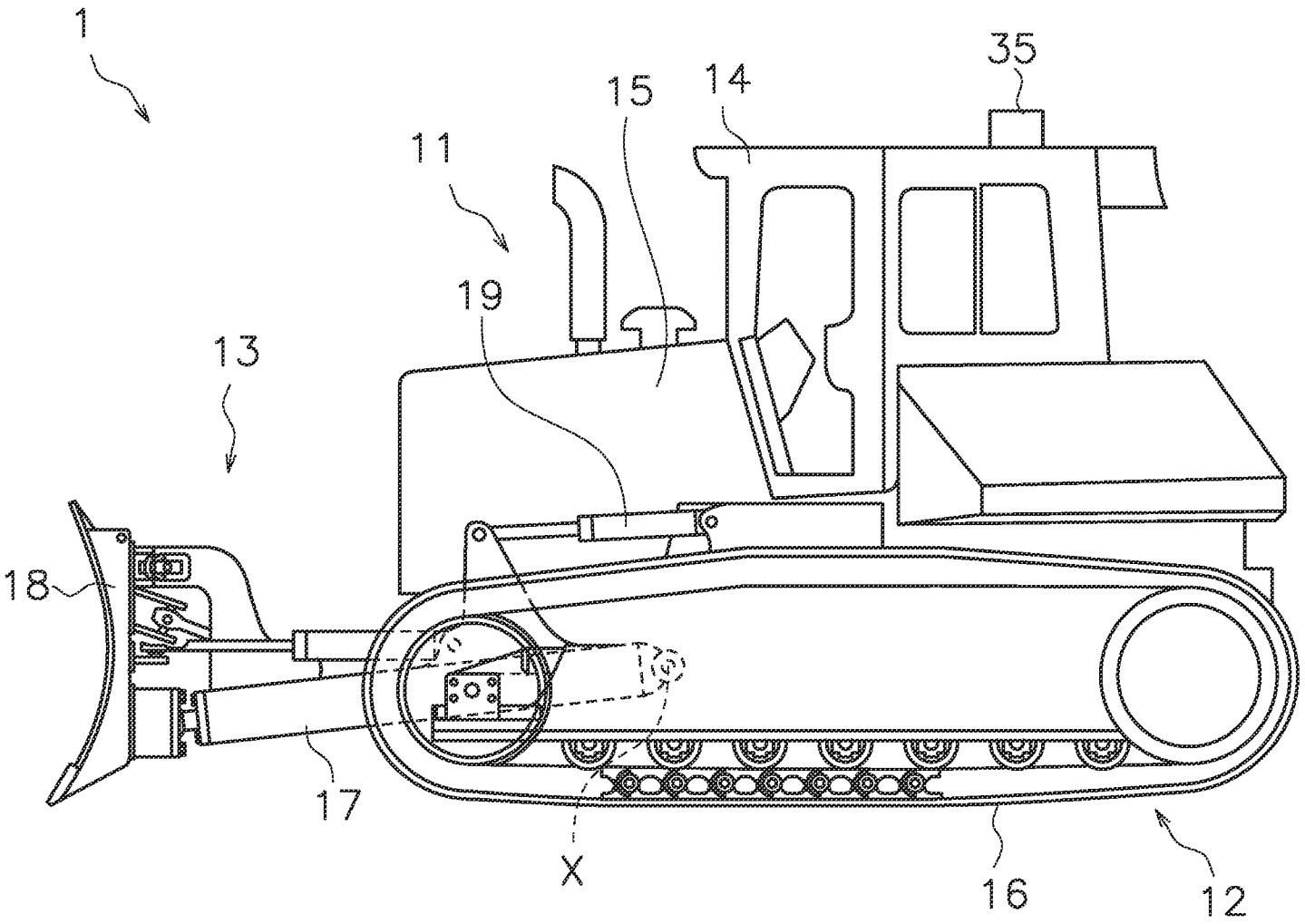
FIG. 1 is a side view of a work machine according to an embodiment.

Hereinafter, a work machine according to an embodiment will be described with reference to the drawings. FIG. 1 is a side view of a work machine 1 according to the embodiment. The work machine 1 according to the present embodiment is a bulldozer. The work machine 1 includes a vehicle body 11, a travel device 12, and a work implement 13.

The vehicle body 11 includes an operating cabin 14 and an engine compartment 15. An operator's seat that is not illustrated is disposed in the operating cabin 14. The engine compartment 15 is disposed in front of the operating cabin 14. The travel device 12 is attached to a lower portion of the vehicle body 11. The travel device 12 includes a pair of left and right crawler belts 16. Only the left crawler belt 16 is illustrated in FIG. 1. The work machine 1 travels due to the rotation of the crawler belts 16. The travel of the work machine 1 may be either autonomous travel, semi-autonomous travel, or travel under operation by an operator.

The work implement 13 is attached to the vehicle body 11. The work implement 13 includes a lift frame 17, a blade 18, and a lift cylinder 19. The lift frame 17 is attached to the vehicle body 11 so as to be movable up and down around an axis X extending in the vehicle width direction. The lift frame 17 supports the blade 18. The blade 18 is disposed in front of the vehicle body 11. The blade 18 moves up and down accompanying the up and down movements of the lift frame 17. The lift cylinder 19 is coupled to the vehicle body 11 and the lift frame 17. Due to the extension and contraction of the lift cylinder 19, the lift frame 17 rotates up and down around the axis X.

Figure 2:
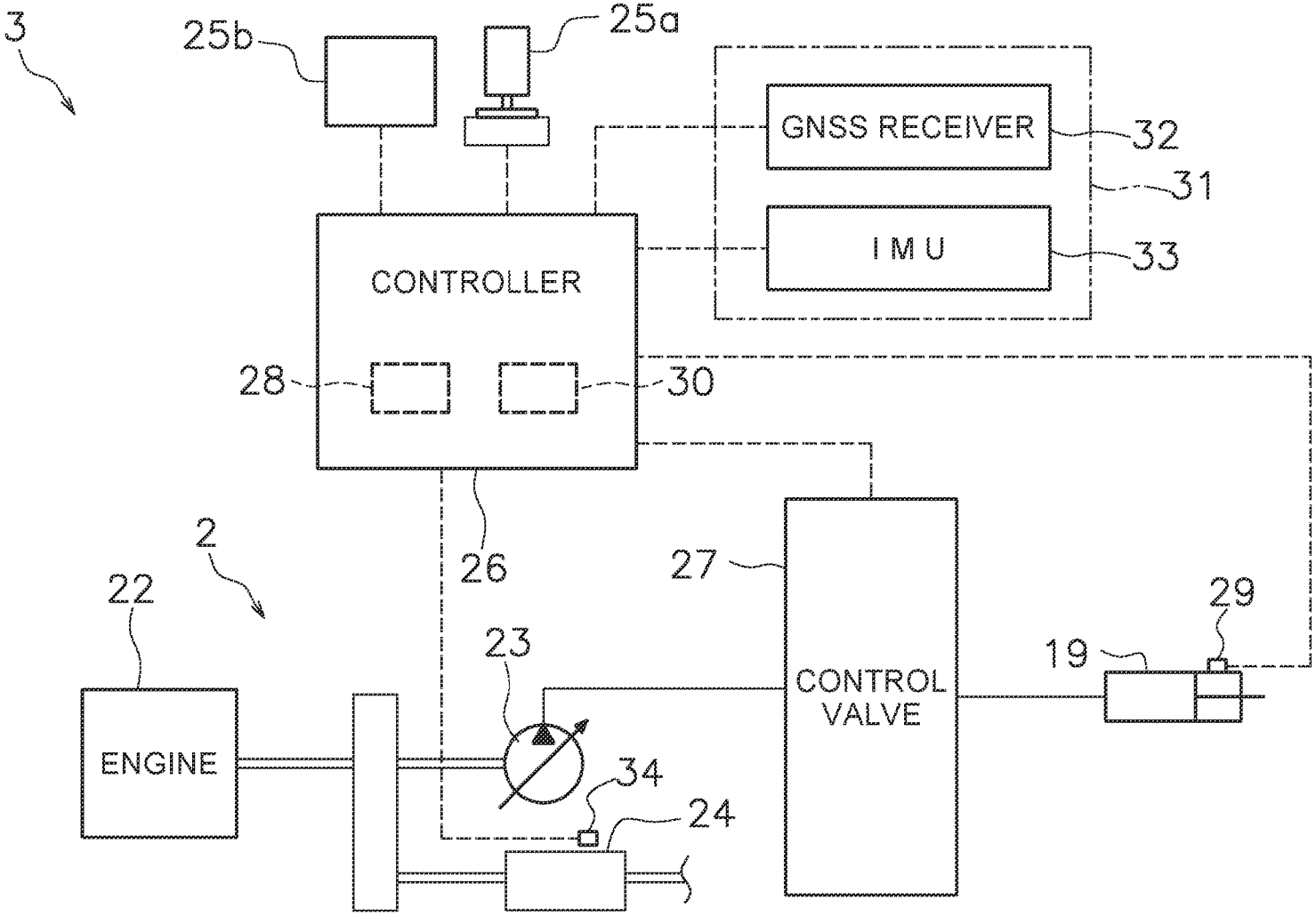
FIG. 2 is a block diagram illustrating a configuration of a drive system and a control system of the work machine.

FIG. 2 is a block diagram illustrating a configuration of a drive system 2 and a control system 3 of the work machine 1. As illustrated in FIG. 2, the drive system 2 includes an engine 22, a hydraulic pump 23, and a power transmission device 24. The hydraulic pump 23 is driven by the engine 22 to discharge hydraulic fluid. The hydraulic fluid discharged from the hydraulic pump 23 is supplied to the lift cylinder 19. Although one hydraulic pump 23 is illustrated in FIG. 2, a plurality of hydraulic pumps may be provided.

The power transmission device 24 transmits driving force of the engine 22 to the travel device 12. The power transmission device 24 may be, for example, a hydro static transmission (HST). Alternatively, the power transmission device 24 may be, for example, a transmission having a torque converter or a plurality of transmission gears.

The control system 3 includes an operating device 25*a*, an input device 25*b*, a controller 26, a storage device 28, and a control valve 27. The operating device 25*a* is a device for operating the work implement 13 and the travel device 12. The operating device 25*a* is disposed in the operating cabin 14. The operating device 25*a* receives an operation by an operator for driving the work implement 13 and the travel device 12, and outputs an operation signal corresponding to the operation. The operating device 25*a* includes, for example, an operating lever, a pedal, a switch, and the like.

For example, the operating device 25*a* for the travel device 12 is configured to be operated at a forward position, a reverse position, and a neutral position. An operation signal indicative of a position of the operating device 25*a* is output to the controller 26. When the operating position of the operating device 25*a* is the forward position, the controller 26 controls the travel device 12 or the power transmission device 24 so that the work machine 1 travels forward. When the operating position of the operating device 25*a* is the reverse position, the controller 26 controls the travel device 12 or the power transmission device 24 so that the work machine 1 travels in reverse.

The input device 25*b* is, for example, a touch screen type input device. The input device 25*b* may be another type of input device, such as a switch. The operator can input a setting for automatic control described later by using the input device 25*b*.

The controller 26 is programmed to control the work machine 1 based on acquired data. The controller 26 includes the storage device 28 and a processor 30. The processor 30 includes, for example, a CPU. The storage device 28 includes, for example, a memory and an auxiliary storage device. The storage device 28 may be, for example, a RAM or a ROM. The storage device 28 may be a semiconductor memory, a hard disk, or the like. The storage device 28 is an example of a non-transitory computer-readable recording medium. The storage device 28 stores computer commands that are executable by the processor 30 and for controlling the work machine 1.

The controller 26 acquires an operation signal from the operating device 25*a*. The controller 26 controls the control valve 27 based on the operation signal. The controller 26 is not limited to one unit and may be divided into a plurality of controllers.

The control valve 27 is a proportional control valve and controlled by a command signal from the controller 26. The control valve 27 is disposed between a hydraulic actuator, such as the lift cylinder 19, and the hydraulic pump 23. The control valve 27 controls the flow rate of the hydraulic fluid supplied from the hydraulic pump 23 to the lift cylinder 19. The controller 26 generates a command signal to the control valve 27 so that the blade 18 operates according to the operation of the operating device 25*a* described above. As a result, the lift cylinder 19 is controlled according to an amount of operation of the operating device 25*a*. The control valve 27 may be a pressure proportional control valve. Alternatively, the control valve 27 may be an electromagnetic proportional control valve.

Figure 3:
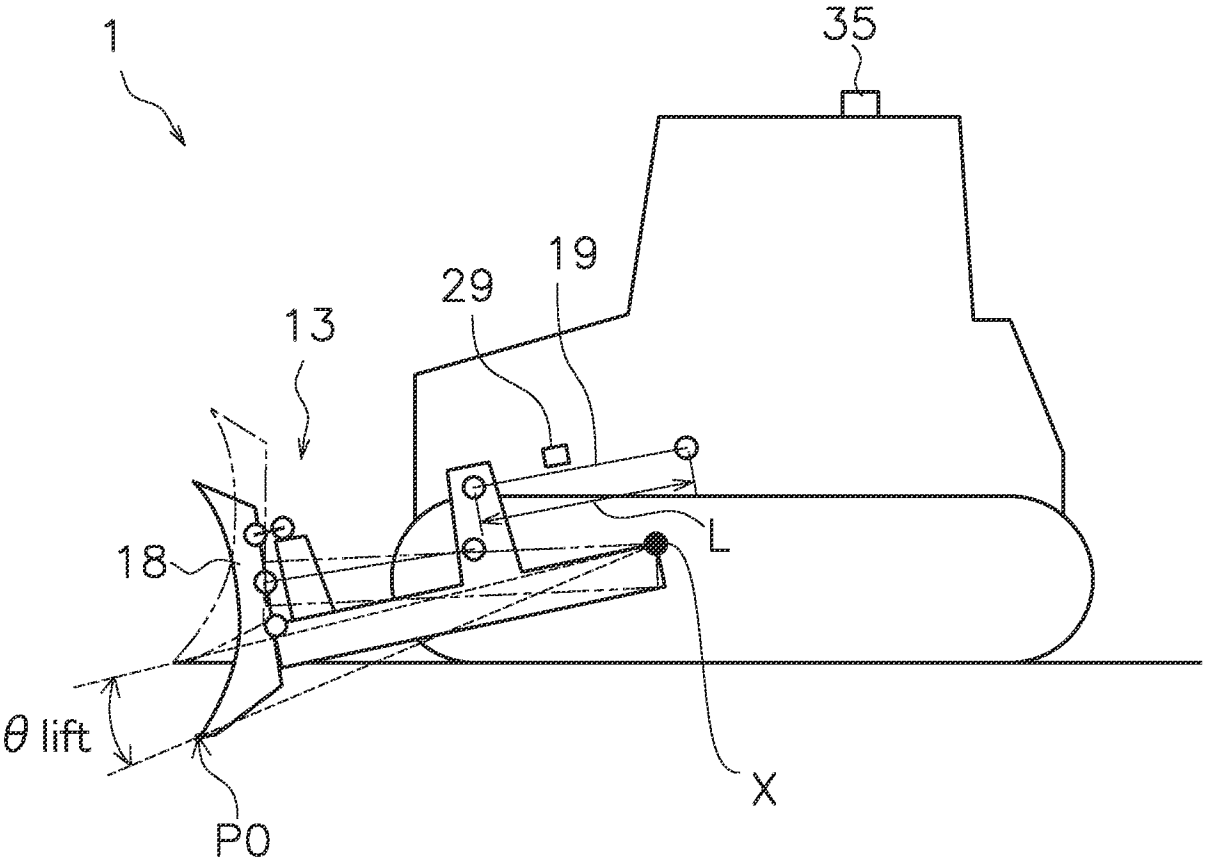
FIG. 3 is a schematic view illustrating a configuration of the work machine.

The control system 3 includes a lift cylinder sensor 29. The lift cylinder sensor 29 detects the stroke length of the lift cylinder 19 (hereinafter referred to as "lift cylinder length L"). As illustrated in FIG. 3, the controller 26 calculates a lift angle θ lift of the blade 18 based on the lift cylinder length L. FIG. 3 is a schematic view illustrating a configuration of the work machine 1.

In FIG. 3, the origin position of the work implement 13 is indicated by a chain double-dashed line. The origin position of the work implement 13 is the position of the blade 18 in a state where the tip of the blade 18 is in contact with the ground surface on a horizontal ground surface. The lift angle θ lift is the angle from the origin position of the work implement 13.

As illustrated in FIG. 2, the control system 3 includes a position sensor 31. The position sensor 31 measures a position of the work machine 1. The position sensor 31 includes a global navigation satellite system (GNSS) receiver 32, an IMU 33, and an antenna 35. The GNSS receiver 32 is, for example, a receiver for global positioning system (GPS). The GNSS receiver 32 receives a positioning signal from a satellite and calculates the position of the antenna 35 from the positioning signal to generate vehicle body position data. The controller 26 acquires the vehicle body position data from the GNSS receiver 32.

The IMU 33 is an inertial measurement unit. The IMU 33 acquires vehicle body inclination angle data and vehicle body acceleration data. The vehicle body inclination angle data includes an angle with respect to the horizontal in the vehicle longitudinal direction (pitch angle) and an angle with respect to the horizontal in the vehicle lateral direction (roll angle). The vehicle body acceleration data includes the acceleration of the work machine 1. The controller 26 acquires the traveling direction and vehicle speed of the work machine 1 from the vehicle body acceleration data. The controller 26 acquires the vehicle body inclination angle data and the vehicle body acceleration data from the IMU 33.

The controller 26 calculates a blade tip position P0 from the lift cylinder length L, the vehicle body position data, and the vehicle body inclination angle data. As illustrated in FIG. 3, the controller 26 calculates global coordinates of the GNSS receiver 32 based on the vehicle body position data. The controller 26 calculates the lift angle θ lift based on the lift cylinder length L. The controller 26 calculates local coordinates of the blade tip position P0 with respect to the GNSS receiver 32 based on the lift angle θ lift and vehicle body dimension data. The controller 26 calculates the traveling direction and vehicle speed of the work machine 1 from the vehicle body acceleration data. The vehicle body dimension data is stored in the storage device 28 and indicates a position of the work implement 13 with respect to the GNSS receiver 32. The controller 26 calculates global coordinates of the blade tip position P0 based on the global coordinates of the GNSS receiver 32, the local coordinates of the blade tip position P0, and the vehicle body inclination angle data. The controller 26 acquires the global coordinates of the blade tip position P0 as blade tip position data.

The control system 3 includes an output sensor 34 that measures an output of the power transmission device 24. When the power transmission device 24 is an HST including a hydraulic motor, the output sensor 34 may be a pressure sensor that detects driving hydraulic pressure of the hydraulic motor. The output sensor 34 may be a rotation sensor that detects an output rotation speed of the hydraulic motor. When the power transmission device 24 includes a torque converter, the output sensor 34 may be a rotation sensor that detects an output rotation speed of the torque converter. A detection signal indicative of a detection value of the output sensor 34 is output to the controller 26.

The controller 26 calculates a traction force of the work machine 1 from the detection value of the output sensor 34. When the power transmission device 24 of the work machine 1 is an HST, the controller 26 can calculate the traction force from the driving hydraulic pressure of the hydraulic motor and the rotation speed of the hydraulic motor. The traction force is a load received by the work machine 1.

When the power transmission device 24 includes a torque converter and a transmission, the controller 26 can calculate the traction force from the output rotation speed of the torque converter. Specifically, the controller 26 calculates the traction force from the following formula (1).

$$F=k\times T\times R/(L\times Z) \quad (1)$$

At this time, F is a traction force, k is a constant, T is a transmission input torque, R is a reduction ratio, L is a crawler belt link pitch, and Z is the number of sprocket teeth. The input torque T is calculated based on the output rotation speed of the torque converter. The method for detecting the traction force is not limited to the afore-mentioned method and may be another method.

The storage device 28 stores work site data and design topography data. The work site data indicates an actual topography of the work site. The work site data is, for example, an actual topography survey map in a three-dimensional data format. The work site data can be acquired, for example, by aerial laser survey.

Figure 4:
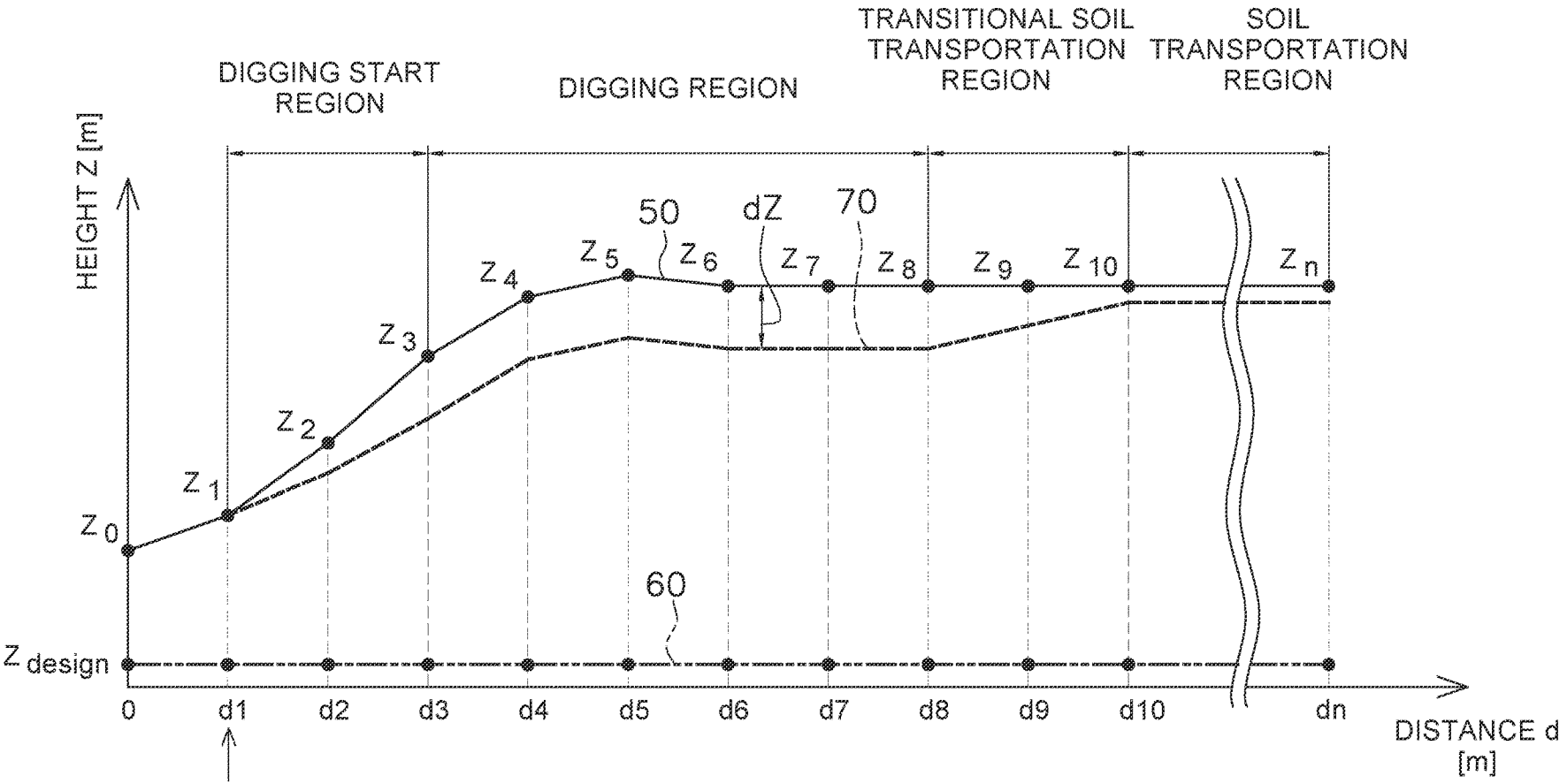
FIG. 4 is a graph illustrating an example of a final design topography, an actual topography, and a target profile.

The controller 26 acquires actual topography data. The actual topography data indicates an actual topography 50 of the work site. FIG. 4 indicates a cross section of the actual topography 50. In FIG. 4, the vertical axis indicates the height of the topography and the horizontal axis indicates the distance from a current position in the traveling direction of the work machine 1.

The actual topography data is information indicative of a topography positioned in the traveling direction of the work machine 1. The actual topography data is acquired by calculation in the controller 26 from the work site data, the position of the work machine 1 acquired from the afore-mentioned position sensor 31, and the traveling direction of the work machine 1.

Specifically, the actual topography data includes heights Z0 to Zn of the actual topography 50 at a plurality of reference points from the current position to a predetermined topography recognition distance do in the traveling direction of the work machine 1. In the present embodiment, the current position is a position determined based on the current blade tip position P0 of the work machine 1. The current position may be determined based on a current position of another portion of the work machine 1. The plurality of reference points are arranged at a predetermined interval, for example, every one meter.

The design topography data indicates a final design topography 60. The final design topography 60 is a final target shape of a surface of the work site. The design topography data is, for example, a construction drawing in a three-dimensional data format. As illustrated in FIG. 4, the design topography data includes a height Z design of the final design topography 60 at a plurality of reference points in the traveling direction of the work machine 1. The plurality of reference points indicate a plurality of points at a predetermined interval along the traveling direction of the work machine 1. In FIG. 4, the final design topography 60 has a flat shape parallel to the horizontal direction, but may have a different shape.

The controller 26 automatically controls the work implement 13 based on the actual topography data, the design topography data, and the blade tip position data. The automatic control of the work implement 13 may be a semi-automatic control that is performed in combination with manual operations by an operator. Alternatively, the automatic control of the work implement 13 may be a fully automatic control that is performed without manual operations by an operator.

Figure 5:
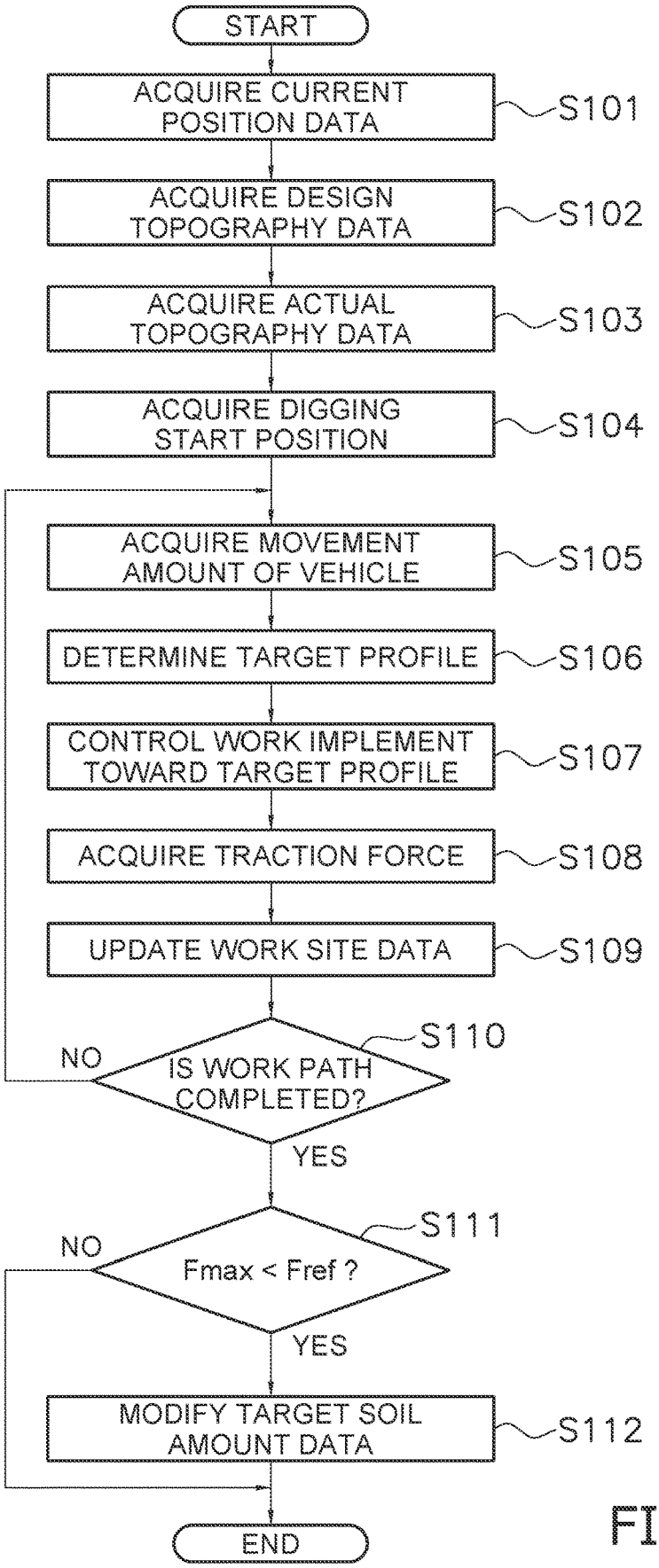
FIG. 5 is a flowchart illustrating processes of automatic control of a work implement.

Hereinafter, the automatic control of the work implement 13 in digging executed by the controller 26 will be described. FIG. 5 is a flowchart illustrating processes of the automatic control of the work implement 13 in digging work. FIG. 5 illustrates the processes in one work path in digging work. The one work path indicates steps from when the work machine 1 starts traveling forward from a digging start position and then performs a series of digging work until the work machine 1 starts traveling in reverse in order to move to a next digging start position.

As illustrated in FIG. 5, in step S101, the controller 26 acquires current position data. At this time, the controller 26 acquires the current blade tip position P0 of the blade 18 as described above. In step S102, the controller 26 acquires the afore-mentioned design topography data. In step S103, the controller 26 acquires the afore-mentioned actual topography data.

In step S104, the controller 26 acquires a digging start position (work start position). For example, the controller 26 acquires, as the digging start position, the position when the blade tip position P0 first drops below the height Z0 of the actual topography 50. As a result, the position where the tip of the blade 18 is lowered and digging of the actual topography 50 is started is acquired as the digging start position. However, the controller 26 may acquire the digging start position by another method. For example, the controller 26 may acquire the digging start position based on the operation of the operating device 25*a*. For example, the controller 26 may acquire the digging start position based on an operation of a button, a screen operation using a touch screen, or the like.

In step S105, the controller 26 acquires a movement amount of the work machine 1. The controller 26 acquires, as the movement amount, the distance that the work machine 1 travels from the digging start position to the current position. The movement amount of the work machine 1 may be the movement amount of the vehicle body 11. Alternatively, the movement amount of the work machine 1 may be the movement amount of the blade tip position P0 of the blade 18.

In step S106, the controller 26 determines a target profile 70. As illustrated in FIG. 4, the target profile 70 indicates a desired trajectory of the tip of the blade 18 in work. The target profile 70 is a target shape of the topography to be worked and indicates a desired shape as a result of digging work.

The controller 26 determines the target profile 70 so that the target profile 70 does not go below the final design topography 60. Therefore, at the time of digging work, the controller 26 determines the target profile 70 positioned at or above the final design topography 60 and below the actual topography 50.

As illustrated in FIG. 4, the controller 26 determines the target profile 70 that is displaced downward from the actual topography 50 by a target displacement dZ. The target displacement dZ is the target depth at each reference point in the vertical direction. The target displacement dZ is determined from a target soil amount S_target per unit of movement amount to be dug by the blade 18. For example, the controller 26 may calculate the target displacement dZ from the target soil amount S_target and the width of the blade 18.

Figure 6:
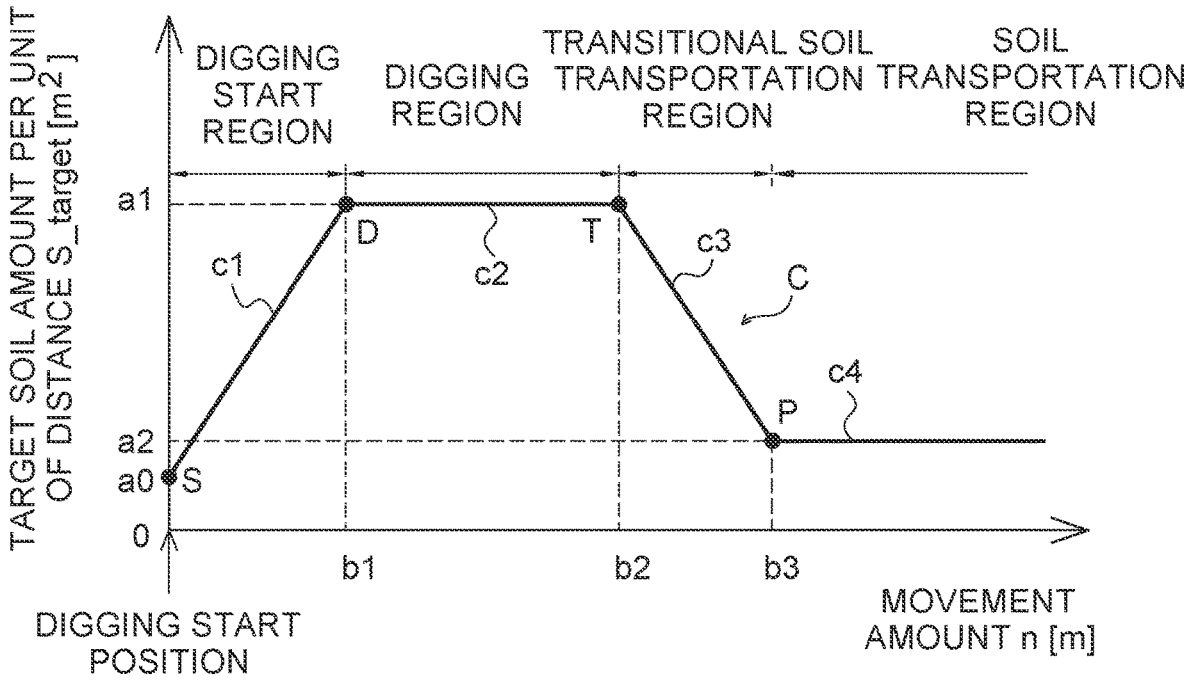
FIG. 6 is a graph illustrating an example of target soil amount data.

The controller 26 refers to target soil amount data C to determine the target soil amount S_target according to the movement amount of the work machine 1. FIG. 6 is a graph illustrating an example of the target soil amount data C. The target soil amount data C indicates the target soil amount S_target per unit of movement amount as a dependent variable of movement amount n of the work machine 1 in the horizontal direction. The controller 26 refers to the target soil amount data C illustrated in FIG. 6 to determine the target soil amount S_target from the movement amount n of the work machine 1.

As illustrated in FIG. 6, the target soil amount data C defines the relationship between the movement amount n of the work machine 1 and the target soil amount S_target. The target soil amount data C is stored in the storage device 28. The target soil amount data C includes data at start c1, data during digging c2, data during transition c3, and data during soil transportation c4.

The data at start c1 defines the relationship between the movement amount n and the target soil amount S_target in a digging start region. The digging start region is the region from a digging start point S to a steady digging start point D. As indicated by the data at start c1, the target soil amount S_target that gradually increases as the movement amount n increases is defined in the digging start region. The data at start c1 defines the target soil amount S_target that increases linearly with respect to the movement amount n.

The data during digging c2 defines the relationship between the movement amount n and the target amount of soil S_target in a digging region. The digging region is the region from the steady digging start point D to a transitional soil transportation start point T. As indicated by the data during digging c2, the target soil amount S_target is defined as a constant value in the digging region. The data during digging c2 defines the target soil amount S_target that is constant with respect to the movement amount n.

The data during transition c3 defines the relationship between the movement amount n and the target soil amount S_target in a transitional soil transportation region. The transitional soil transportation region is the region from a steady digging end point T to a soil transportation start point P. As indicated by the data during transition c3, the target soil amount S_target that gradually decreases as the movement amount n increases is defined in the transitional soil transportation region. The data during transition c3 defines the target soil amount S_target that decreases linearly with respect to the movement amount n.

The data during soil transportation c4 defines the relationship between the movement amount n and the target soil amount S_target in a soil transportation region. The soil transportation region is the region starting from the soil transportation start point P. As indicated by the data during soil transportation c4, the target soil amount S_target is defined as a constant value in the soil transportation region. The data during soil transportation c4 defines the target soil amount S_target that is constant with respect to the movement amount n.

Specifically, the digging region starts at a first start value b1 and ends at a first end value b2. The soil transportation region starts at a second start value b3. The first end value b2 is smaller than the second start value b3. Therefore, the digging region starts when the movement amount n in the digging region is smaller than the movement amount n in the soil transportation region. The target soil amount S_target in the digging region is constant at a first target value a1. The target soil amount S_target in the soil transportation region is constant at a second target value a2. The first target value a1 is larger than the second target value a2. Therefore, as illustrated in FIG. 4, the target displacement dZ defined in the digging region is larger than the target displacement dZ in the soil transportation region.

The target soil amount S_target at the digging start position is a start value a0. The start value a0 is smaller than the first target value a1. The start target value a0 is smaller than the second target value a2.

Figure 7:
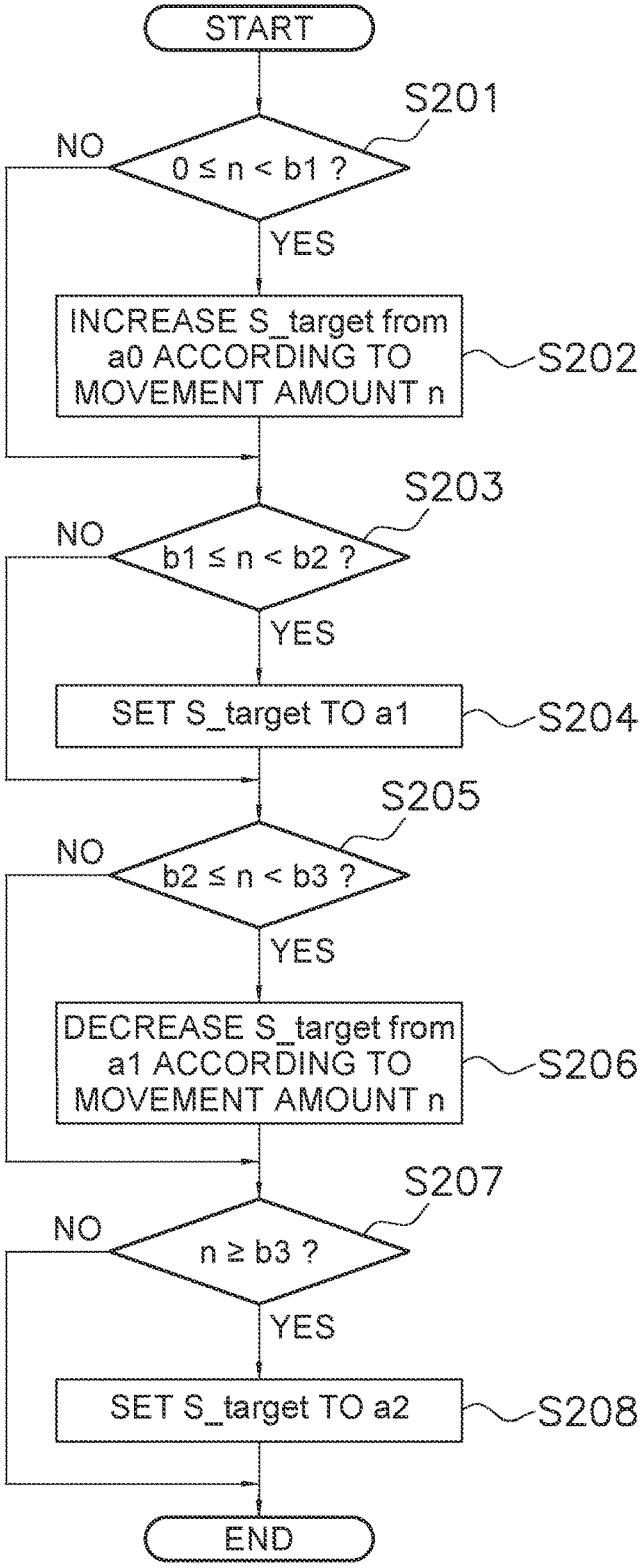
FIG. 7 is a flowchart illustrating processes for determining a target soil amount.

FIG. 7 is a flowchart illustrating processes for determining the target soil amount S_target. The determination processes start when the operating device 25*a* moves to the forward position. In step S201, the controller 26 determines whether the movement amount n is equal to or greater than zero and less than the first start value b1. When the movement amount n is equal to or greater than zero and less than the first start value b1, the controller 26 gradually increases the target soil amount S_target from the start value a0 as the movement amount n increases in step S202.

The start value a0 is a constant and stored in the storage device 28. The start value a0 is preferably a small value at which the load on the blade 18 at the digging start will not be excessively large. The first start value b1 is acquired by calculation from an inclination c1 in the digging start region as illustrated in FIG. 6, the start value a0, and the first target value a1. The inclination c1 is a constant and stored in the storage device 28. The inclination c1 is preferably a value at which a quick transition from the digging start to the digging work can be performed and the load on the blade 18 will not be excessively large.

In step S203, the controller 26 determines whether the movement amount n is equal to or greater than the first start value b1 and less than the first end value b2. When the movement amount n is equal to or greater than the first start value b1 and less than the first end value b2, the controller 26 sets the target soil amount S_target to the first target value a1 in step S204. The first target value a1 is a constant and stored in the storage device 28. The first target value a1 is preferably a value at which the digging can be performed efficiently and the load on the blade 18 will not be excessively large.

In step S205, the controller 26 determines whether the movement amount n is equal to or greater than the first end value b2 and less than the second start value b3. When the movement amount n is equal to or greater than the first end value b2 and less than the second start value b3, the controller 26 gradually decreases the target soil amount S_target from the first target value a1 as the movement amount n increases in step S206.

The first end value b2 is a movement amount at a time when a current amount of soil held by the blade 18 exceeds a predetermined threshold. Therefore, when the current amount of soil held by the blade 18 exceeds the predetermined threshold, the controller 26 decreases the target soil amount S_target from the first target value a1. The predetermined threshold is determined based, for example, on the maximum capacity of the blade 18. For example, the current amount of soil held by the blade 18 may be determined by measuring the load on the blade and calculating from this load. Alternatively, the current amount of soil held by the blade 18 may be calculated by capturing an image of the blade 18 with a camera and analyzing this image.

At the start of work, a predetermined initial value is set as the first end value b2. After the start of work, the movement amount when the amount of soil held by the blade 18 exceeds the predetermined threshold is stored as an updated value, and the first end value b2 is updated based on the stored updated value.

In step S207, the controller 26 determines whether the movement amount n is equal to or greater than the second start value b3. When the movement amount n is equal to or greater than the second start value b3, the controller 26 sets the target soil amount S_target to the second target value a2 in step S208.

The second target value a2 is a constant and stored in the storage device 28. The second target value a2 is preferably set to a value suitable for the soil transportation work. The second start value b3 is acquired by calculation from an inclination c3 in the transitional soil transportation region as illustrated in FIG. 6, the first target value a1, and the second target value a2. The inclination c3 is a constant and stored in the storage device 28. The inclination c3 is preferably a value at which a quick transition from the digging work to the soil transportation work can be performed and the load on the blade 18 will not be excessively large.

The start value a0, the first target value a1, and the second target value a2 may be changed according to a condition of the work machine 1, or the like. The first start value b1, the first end value b2, and the second start value b3 may be stored in the storage device 28 as constants.

The target soil amount S_target is determined as described above. The controller 26 determines the target displacement dZ according to the movement amount n from the target soil amount S_target. Then, the height Z of the target profile 70 is determined from the height Z of the actual topography 50 and the target displacement dZ.

In step S107 illustrated in FIG. 5, the controller 26 controls the blade 18 toward the target profile 70. At this time, the controller 26 generates a command signal to the work implement 13 so that the tip position of the blade 18 moves toward the target profile 70 determined in step S106. The generated command signal is input to the control valve 27. As a result, the blade tip position P0 of the work implement 13 moves along the target profile 70.

In the afore-mentioned digging region, the target displacement dZ between the actual topography 50 and the target profile 70 is large in comparison with the other regions. Accordingly, the digging work of the actual topography 50 is performed in the digging region. In the soil transportation region, the target displacement dZ between the actual topography 50 and the target profile 70 is small in comparison with the other regions. Accordingly, the digging of the ground surface is suppressed and the soil held by the blade 18 is transported in the soil transportation region.

In step S108, the controller 26 acquires a traction force of the work machine 1. The controller 26 acquires the traction force of the work machine 1 during the one work path at a predetermined sampling cycle and stores it in the storage device 28.

In step S109, the controller 26 updates the work site data. The controller 26 acquires the position data indicative of the latest trajectory of the blade tip position P0 as the actual topography data and updates the work site data according to the acquired actual topography data. Alternatively, the controller 26 may calculate a position of the bottom surface of the crawler belts 16 from the vehicle body position data and the vehicle body dimension data and acquire the position data indicative of the trajectory of the bottom surface of the crawler belts 16 as the actual topography data. In this case, the update of the work site data can be performed instantly.

Alternatively, the actual topography data may be generated from survey data measured by a survey device outside of the work machine 1. For example, aerial laser survey may be used as an external survey device. Alternatively, the actual topography 50 may be captured by a camera and the actual topography data may be generated from image data acquired by the camera. For example, aerial photographic survey using an unmanned aerial vehicle (UAV) may be used. In the case of using the external survey device or camera, the work site data may be updated at a predetermined interval, or as needed.

In step S110, the controller 26 determines whether the current work path is completed. The controller 26 determines that the current work path is completed when the work machine 1 reaches a predetermined work end position. Alternatively, the controller 26 may determine that the current work path is completed when the work machine 1 is switched from the forward travel to the travel in reverse. When the current work path is completed, the process proceeds to step S111. When the current work path is not completed, the process returns to step S105.

In step S111, the controller 26 determines whether a maximum traction force Fmax during the current work path is smaller than a reference traction force Fref. The controller 26 acquires, as the maximum traction force Fmax, the largest of traction forces detected during the current work path. The reference traction force Fref may be determined from the maximum value of the traction force that the work machine 1 can produce. The reference traction force Fref may be a fixed value. The reference traction force Fref may be set by the input device 25*b*. When the maximum traction force Fmax is smaller than the reference traction force Fref, the process proceeds to step S112.

Figure 8:
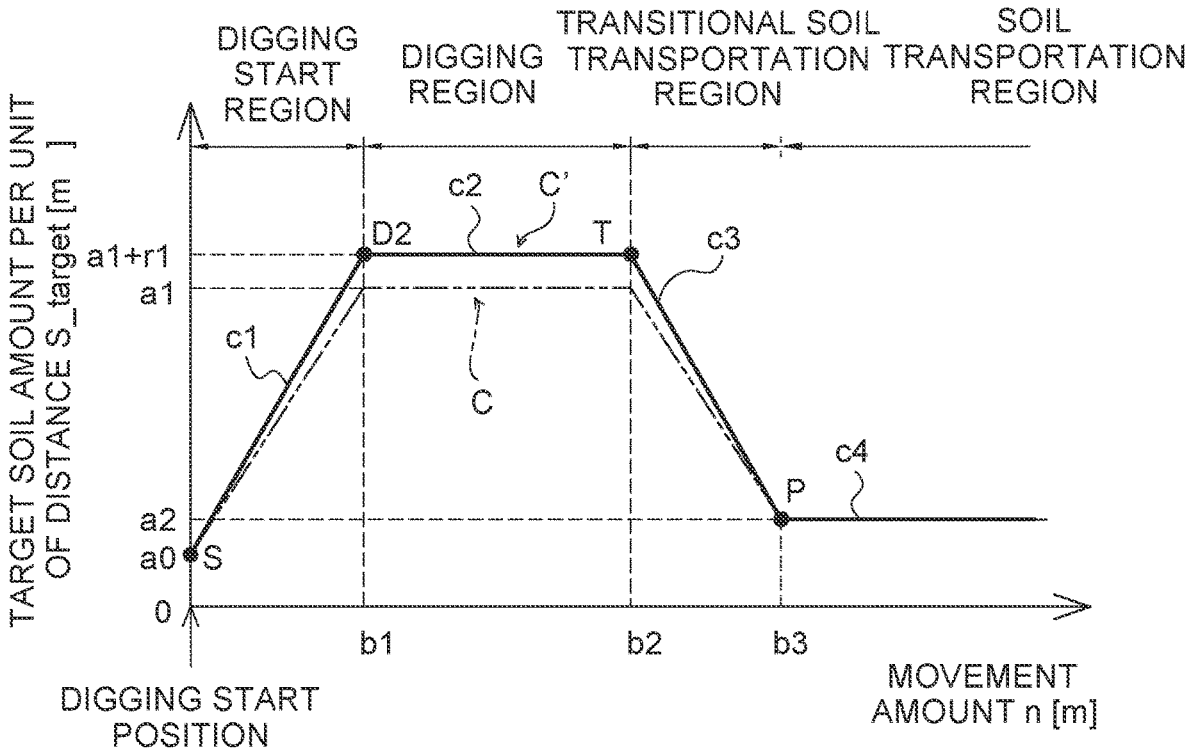
FIG. 8 is a graph illustrating an example of the modified target soil amount data.

In step S112, the controller 26 modifies the target soil amount data C. As illustrated in FIG. 8, the controller 26 increases the target soil amount S_target in the digging region from the first target value a1 by an increment r1 in the target soil amount data C. As a result, the controller 26 modifies the target soil amount data C indicated by the chain double-dashed line in FIG. 8 to the target soil amount data C' indicated by the solid line.

Upon completing the one work path as described above, the work machine 1 travels in reverse in order to move to a next digging start position. Then, when the work machine 1 travels forward again, a next work path is started. The controller 26 executes the above processes for the next work path.

Figure 9:
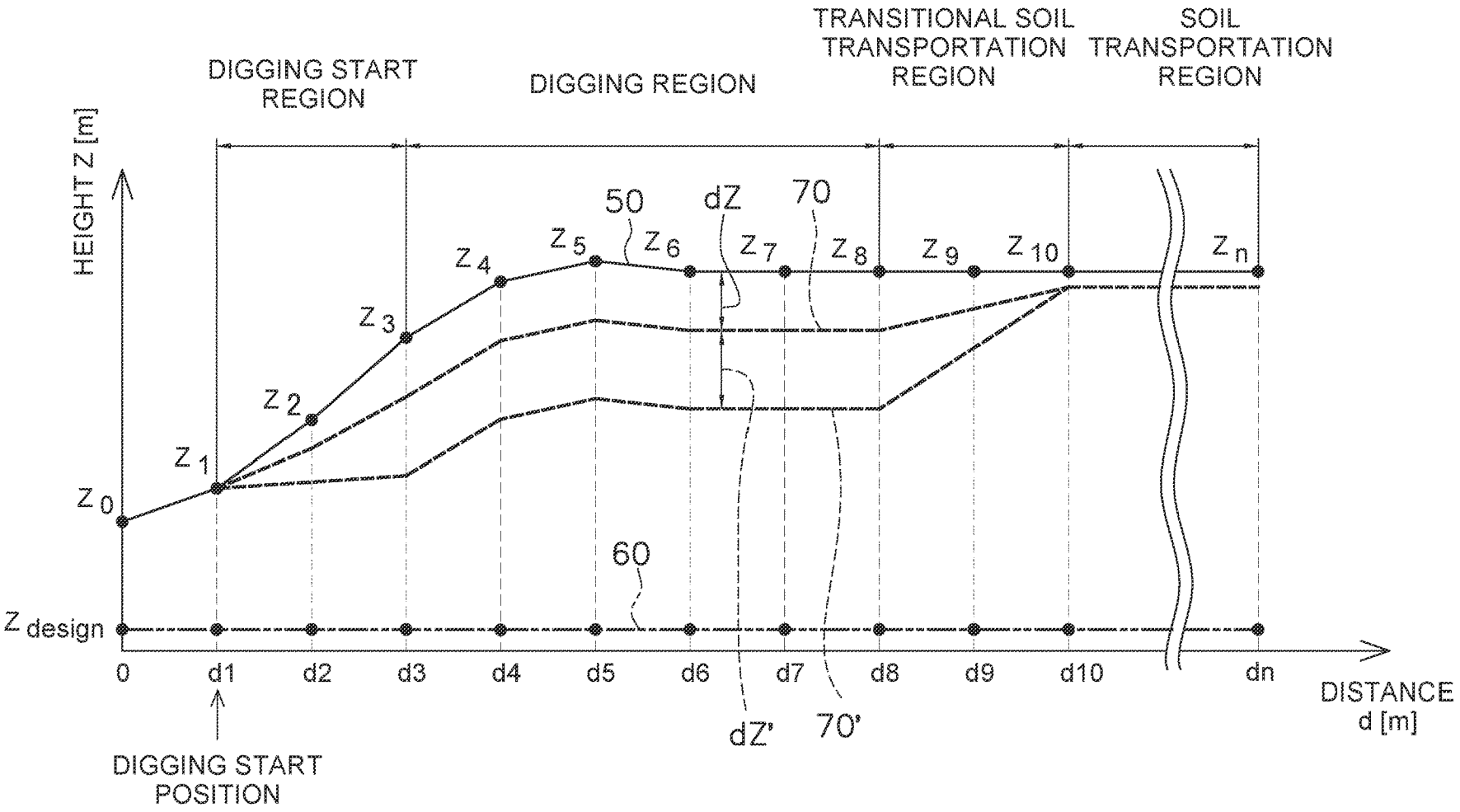
FIG. 9 is a graph illustrating an example of the target profile in a current work path and the target profile in a next work path.

That is, the controller 26 updates the actual topography 50 based on the updated work site data. The controller 26 refers to the modified target soil amount data to determine the target soil amount S_target according to the movement amount of the work machine 1. When the maximum traction force Fmax during the previous work path is smaller than the reference traction force Fref, the target soil amount S_target is increased in the next work path as illustrated in FIG. 8. The controller 26 determines a target displacement dZ' from the increased target soil amount S_target. Therefore, as illustrated in FIG. 9, the target displacement dZ' in the next work path is larger than the target displacement dZ in the previous work path. The controller 26 determines a target profile 70' in the next work path based on the increased target displacement dZ'. Then, the controller 26 controls the blade 18 according to the newly determined target profile 70'. These processes are repeated to perform digging so that the actual topography 50 approaches the final design topography 60.

With the control system 3 of the work machine 1 according to the present embodiment described above, it is determined whether the maximum traction force Fmax during the one work path is smaller than the reference traction force Fref. When the maximum traction force Fmax is smaller than the reference traction force Fref, the target soil amount S_target in the next work path is increased. Then, the target profile 70' in the next work path is determined based on the increased target soil amount S_target. As a result, it is possible to perform work efficiently under automatic control and to prevent a topography with large unevenness from being formed due to the work.

Although an embodiment of the present invention has been described so far, the present invention is not limited to the above embodiment and various modifications can be made without departing from the gist of the invention.

The work machine 1 is not limited to a bulldozer and may be another vehicle, such as a wheel loader, a motor grader, or the like.

The work machine 1 may be a vehicle that can be remotely operated. In this case, a portion of the control system 3 may be disposed outside of the work machine 1. For example, the controller 26 may be disposed outside of the work machine 1. The controller 26 may be disposed in a control center that is away from the work site.

Figure 10:
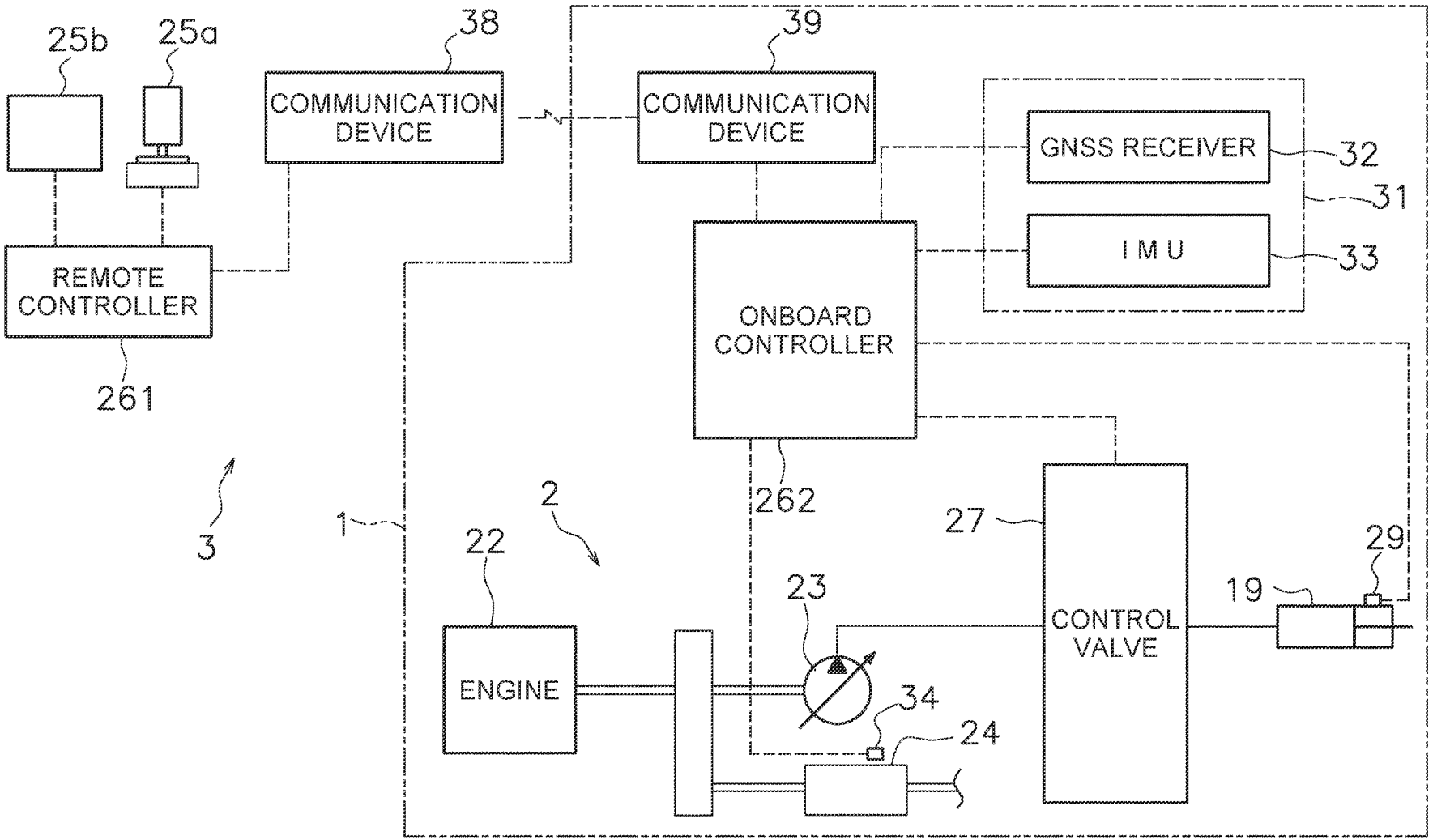
FIG. 10 is a block diagram illustrating a configuration of the control system according to another embodiment.

The controller 26 may have a plurality of controllers that are separate from each other. For example, as illustrated in FIG. 10, the controller 26 may include a remote controller 261 disposed outside of the work machine 1 and an onboard controller 262 mounted on the work machine 1. The remote controller 261 and the onboard controller 262 may be able to wirelessly communicate with each other via communication devices 38 and 39. A portion of the afore-mentioned functions of the controller 26 may be executed by the remote controller 261 and the remaining functions may be executed by the onboard controller 262. For example, the processes for determining the target profile 70 may be executed by the remote controller 261 and the processes for outputting the command signal to the work implement 13 may be executed by the onboard controller 262.

The operating device 25*a* and the input device 25*b* may be disposed outside of the work machine 1. In this case, the operating cabin may be omitted from the work machine 1. Alternatively, the operating device 25*a* and the input device 25*b* may be omitted from the work machine 1. The work machine 1 may be operated with only the automatic control by the controller 26 without operations by the operating device 25*a*.

Figure 11:
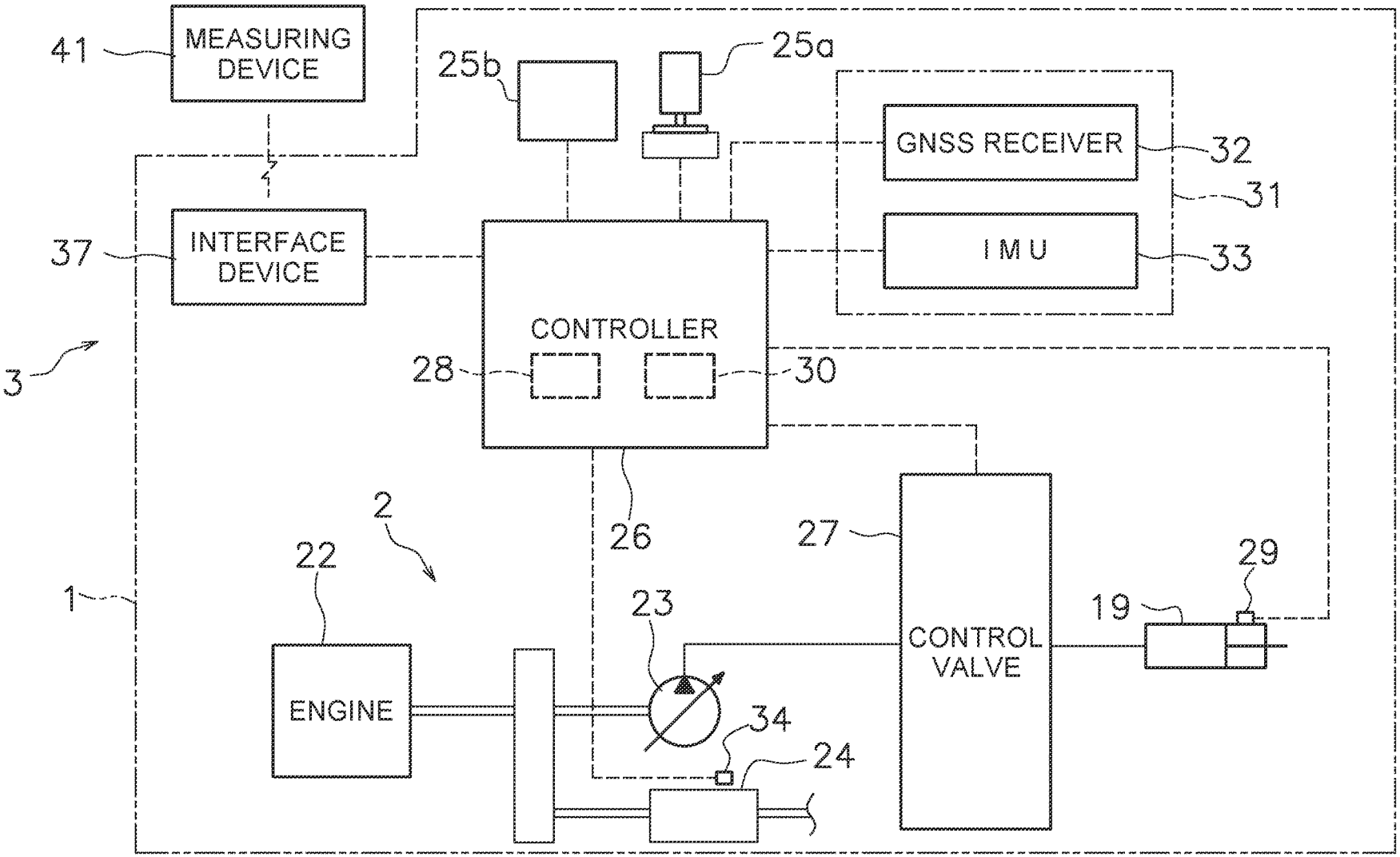
FIG. 11 is a block diagram illustrating a configuration of the control system according to another embodiment.

The actual topography 50 may be acquired by another device, instead of the afore-mentioned position sensor 31. For example, as illustrated in FIG. 11, the actual topography 50 may be acquired by an interface device 37 that receives data from an external device. The interface device 37 may wirelessly receive the actual topography data measured by a measuring device 41 disposed outside. Alternatively, the interface device 37 may be a recording medium reading device and may receive the actual topography data measured by the external measuring device 41 via the recording medium.

Figure 12:
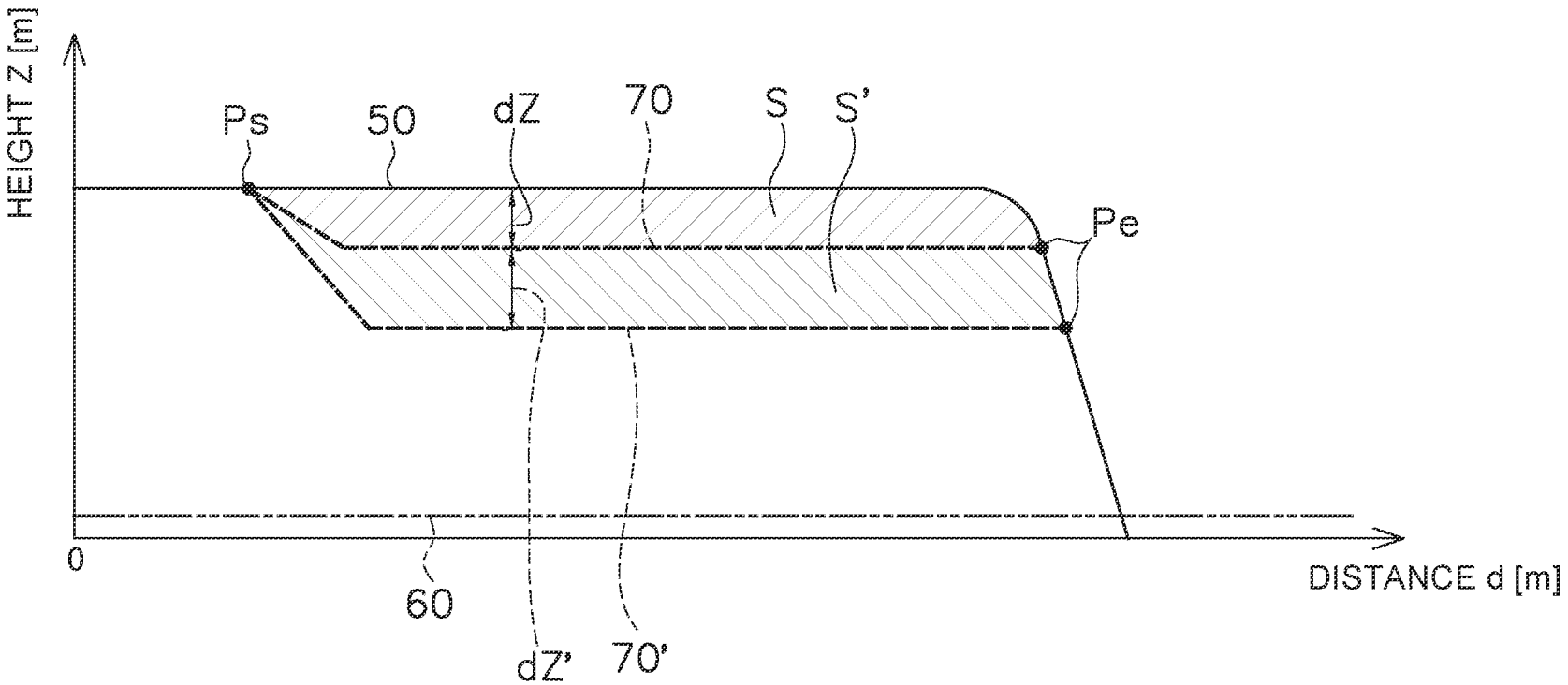
FIG. 12 is a graph illustrating the target profile according to a first modified example.

The processes by the controller 26 are not limited to those of the above embodiment and may be changed. For example, the processes for determining the target profile 70 may be changed. The target soil amount may be determined regardless of the movement amount n of the work machine 1. As illustrated in FIG. 12, in a case where a start point Ps and an end point Pe of the target profile 70 are determined, the controller 26 may determine the target displacement dZ of the target profile 70 in one work path so that the total soil amount between the actual topography 50 and the target profile 70 is the target soil amount S. Also, when the maximum traction force in the one work path is smaller than the reference traction force, the controller 26 may determine the target displacement dZ' of the target profile 70' in a next work path so that the total soil amount between the actual topography 50 and the target profile 70' is the increased target soil amount S'.

Figure 13:
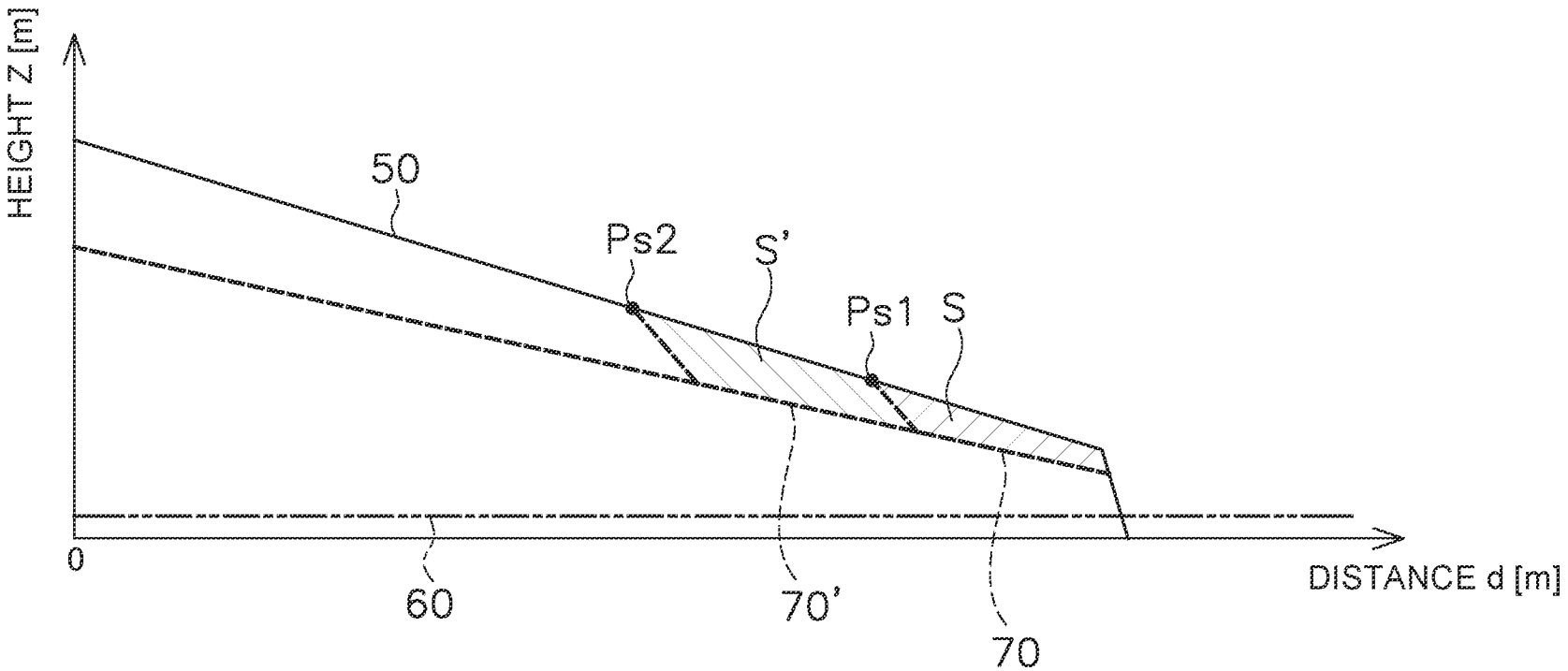
FIG. 13 is a graph illustrating the target profile according to a second modified example.

Alternatively, the controller 26 may determine a starting end or a terminating end of the target profile 70 based on the target soil amount. For example, as illustrated in FIG. 13, the controller 26 may determine a starting end Ps1 of the target profile 70 in one work path based on the target soil amount S. When the maximum traction force in the one work path is smaller than the reference traction force, the controller 26 may determine a starting end Ps2 of the target profile 70 in a next work path based on the increased target soil amount S'.

Figure 14:
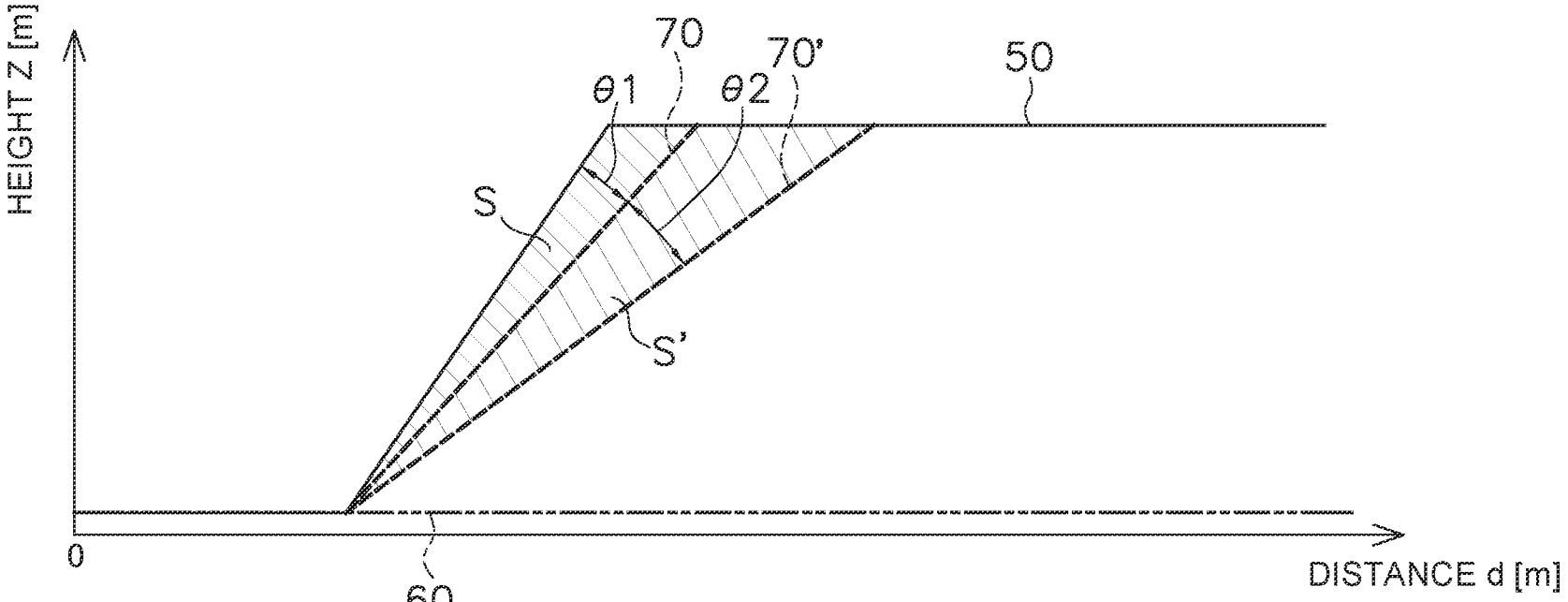
FIG. 14 is a graph illustrating the target profile according to a third modified example.
Figure 15:
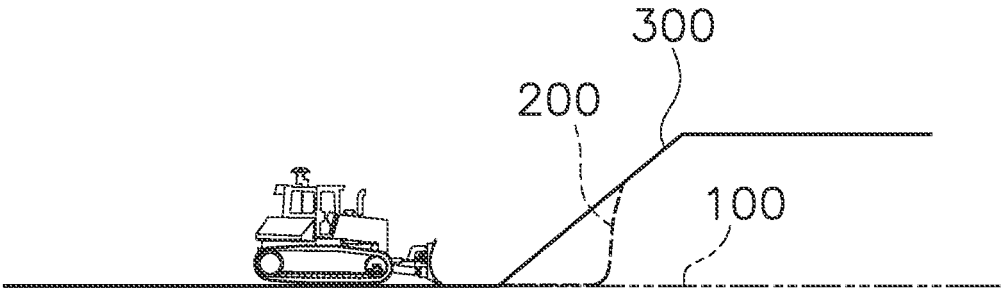
FIG. 15 (PRIOR ART)
FIG. 15 is a view illustrating digging work according to a prior art.

The target profile 70 may be determined independently of the shape of the actual topography 50. That is, the target profile 70 does not have to be parallel to the actual topography 50. For example, the target profile 70 may be a horizontal surface. Alternatively, the target profile may be an inclined surface inclined at a predetermined angle with respect to the horizontal surface. As illustrated in FIG. 14, the controller 26 may determine an inclination angle θ1 of the target profile 70 in one work path based on the target soil amount S. When the maximum traction force in the one work path is smaller than the reference traction force, the controller 26 may determine an inclination angle θ2 of the target profile 70' in a next work path based on the increased target soil amount S'.

According to the present disclosure, it is possible to perform work efficiently under automatic control and to prevent a topography with large unevenness from being formed due to the work.

The invention claimed is:

1. A system for controlling a work machine including a work implement, the system comprising:

a sensor configured to detect a current position of the work machine; and a controller configured to communicate with the sensor, the controller being programmed to:

acquire current position data indicative of the current position of the work machine, acquire actual topography data indicative of an actual topography to be worked by the work machine, acquire a target soil amount in one work path with respect to the actual topography, determine a target profile in the one work path based on the target soil amount, perform work in the one work path by operating the work implement according to the target profile, acquire a maximum traction force of the work machine during the work performed in the one work path, determine whether the maximum traction force is smaller than a reference traction force, increase the target soil amount in a next work path when the maximum traction force is smaller than the reference traction force, and determine the target profile in the next work path based on the increased target soil amount.

2. The system according to claim 1, wherein the controller is further programmed to determine a topography in which the actual topography is displaced in a vertical direction as the target profile based on the actual topography data.

3. The system according to claim 2, wherein the controller is further programmed to:

determine a target displacement of the actual topography in the vertical direction for the one work path based on the target soil amount, increase the target displacement in the next work path based on the increased target soil amount when the maximum traction force is smaller than the reference traction force in the one work path, and determine the target profile in the next work path based on the increased target displacement.

4. A method for controlling a work machine including a work implement, the method comprising:

acquiring current position data indicative of a current position of the work machine;

acquiring actual topography data indicative of an actual topography to be worked by the work machine;

acquiring a target soil amount in one work path with respect to the actual topography;

determining a target profile in the one work path based on the target soil amount;

performing work in the one work path by operating the work implement according to the target profile;

acquiring a maximum traction force of the work machine during the work performed in the one work path;

determining whether the maximum traction force is smaller than a reference traction force;

increasing the target soil amount in a next work path when the maximum traction force is smaller than the reference traction force; and determining the target profile in the next work path based on the increased target soil amount.

5. The method according to claim 4, further comprising determining a topography in which the actual topography is displaced in a vertical direction as the target profile based on the actual topography data.

6. The method according to claim 5, further comprising:

determining a target displacement of the actual topography in the vertical direction for the one work path based on the target soil amount;

increasing the target displacement in the next work path based on the increased target soil amount when the maximum traction force is smaller than the reference traction force in the one work path; and determining the target profile in the next work path based on the increased target displacement.

7. A work machine comprising:

a work implement;

a sensor configured to detect a current position of the work machine; and a controller configured to communicate with the sensor, the controller being programmed to:

acquire current position data indicative of the current position of the work machine, acquire actual topography data indicative of an actual topography to be worked by the work machine, acquire a target soil amount in one work path with respect to the actual topography, determine a target profile in the one work path based on the target soil amount, perform work in the one work path by operating the work implement according to the target profile, acquire a maximum traction force of the work machine during the work performed in the one work path, determine whether the maximum traction force is smaller than a reference traction force, increase the target soil amount in a next work path when the maximum traction force is smaller than the reference traction force, and determine the target profile in the next work path based on the increased target soil amount.

8. The work machine according to claim 7, wherein the controller is further programmed to determine a topography in which the actual topography is displaced in a vertical direction as the target profile based on the actual topography data.

9. The work machine according to claim 8, wherein the controller is further programmed to:

determine a target displacement of the actual topography in the vertical direction for the one work path based on the target soil amount, increase the target displacement in the next work path based on the increased target soil amount when the maximum traction force is smaller than the reference traction force in the one work path, and determine the target profile in the next work path based on the increased target displacement.

* * * * *